US012320225B2

(12) United States Patent
Roycroft et al.

(10) Patent No.: US 12,320,225 B2
(45) Date of Patent: Jun. 3, 2025

(54) ELECTRIC AUTO-CATCHER

(71) Applicant: Tally Energy Services, LLC, Houston, TX (US)

(72) Inventors: Robert G. Roycroft, Houston, TX (US); Shannon S. Freeman, Tomball, TX (US); Tony Giang, Spring, TX (US)

(73) Assignee: TALLY ENERGY SERVICES, LLC, Houston, TX (US)

( * ) Notice: Subject to any disclaimer, the term of this patent is extended or adjusted under 35 U.S.C. 154(b) by 0 days.

(21) Appl. No.: 18/602,944

(22) Filed: Mar. 12, 2024

(65) Prior Publication Data

US 2024/0328278 A1 Oct. 3, 2024

Related U.S. Application Data

(60) Provisional application No. 63/492,405, filed on Mar. 27, 2023.

(51) Int. Cl.

| | |
|---|---|
| ***E21B 33/068*** | (2006.01) |
| ***E21B 43/12*** | (2006.01) |
| ***F04B 47/12*** | (2006.01) |

(52) U.S. Cl.

CPC ..... *E21B 33/068* (2013.01); *E21B 43/121* (2013.01); *F04B 47/12* (2013.01)

(58) Field of Classification Search

CPC ..... E21B 33/068; E21B 43/121; E21B 43/12; F04B 47/12

See application file for complete search history.

(56) References Cited

U.S. PATENT DOCUMENTS

| | | | | |
|---|---|---|---|---|
| 7,040,401 | B1 * | 5/2006 | McCannon | E21B 43/121 166/70 |
| 2023/0383630 | A1 * | 11/2023 | Thorpe | E21B 43/122 |
| 2024/0159129 | A1 * | 5/2024 | Boyd | E21B 43/121 |

* cited by examiner

*Primary Examiner* — George S Gray

(74) *Attorney, Agent, or Firm* — Park, Vaughan, Fleming & Dowler LLP

(57) ABSTRACT

An electronic auto-catcher for catching and releasing a plunger in a lubricator attached to a well. The electronic auto-catcher may include an electronic actuator and an auto-catcher. The electronic actuator may include an actuator that causes lateral movement of an actuator shaft, which causes lateral movement of a stem adaptor, which causes lateral movement of a catcher stem, which causes lateral movement of a ball catching device. The ball catching device holds the plunger in the lubricator and/or releases the plunger from the lubricator so that it may fall down the well. Lateral movement of the actuator shaft is not necessarily equal to lateral movement of the plunger catching device.

26 Claims, 8 Drawing Sheets

ELECTRIC AUTO-CATCHER

PRIORITY CLAIM

This application claims priority to provisional patent application Ser. No. 63/492,405 filed Mar. 27, 2023, which is fully incorporated herein by reference.

BACKGROUND

Technical Field

Embodiments of the subject matter disclosed herein relate to an improved catcher on a lubricator for an oil and gas well, including an improved electronic auto-catcher.

Discussion of the Background

Manual and pneumatic catchers on a lubricator are known for catching plungers as they arrive in the lubricator and for then holding them there until it is desired to redeploy the plunger into the well, at which point the catcher releases the plunger from its "held" position in the lubricator. Manual catchers are disfavored at least because they require the physical presence of someone at the lubricator to operate the catcher. Pneumatic catchers are disfavored for a variety of reasons. For example, pneumatic catchers that operate by porting well gas to the catcher and expelling that gas to the atmosphere can be hazardous, harmful to the environment, and/or detrimental to environmental, social, and governance ("ESG") ratings. Pneumatic catchers that operate on gas compressed on site by a locally installed compressor can be expensive to install, operate, and maintain.

Thus, there has been an unsolved need for a better catcher that resolves one or more of these prior art problems associated with manual and pneumatic catchers. As will be described in more detail below, and as will be evident to those skilled in the art from the following drawings and corresponding description, the present inventors have done more than simply make electric a prior art manual or pneumatic catcher. Technological and other use issues still abound with a mere electronic catcher. For example, electronic actuators used in electronic catchers tend to be "set" in the sense that the actuators only move a set/given distance between their actuated and non-actuated conditions, i.e. they are either fully open or fully closed. This can make it difficult to integrate them onto lubricators (or in connection with different plungers) requiring different actuation distances and/or where wear in the actuator causes the actuation distance to vary over time. Accordingly, the below-described features and advantages of the disclosed electronic auto-catcher overcome at least those issues in an electronic catcher.

BRIEF DESCRIPTION OF THE DRAWINGS

The following disclosure may be understood by reference to the following description taken in conjunction with the accompanying drawings, in which like reference numerals identify like elements. The accompanying drawings, which are incorporated herein and constitute a part of the specification, illustrate one or more exemplary embodiments of the present invention, except where the drawings are indicated to illustrate the prior art. The present invention should not be considered limited to the following drawings. In the drawings.

DETAILED DESCRIPTION

Various features and advantageous details are explained more fully with reference to the non-limiting embodiments that are illustrated in the accompanying drawings and detailed in the following description. Descriptions of well-known starting materials, processing techniques, components, and equipment are omitted so as not to unnecessarily obscure the invention. It should be understood, however, that the detailed description and the specific examples, while indicating embodiments of the invention, are given by way of illustration only, and not by way of limitation. Various substitutions, modifications, additions, and/or rearrangements within the spirit and/or scope of the underlying inventive concept will become apparent to those skilled in the art from this disclosure.

The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended or implied. To the extent that a term or phrase is intended to have a special meaning, i.e., a meaning other than that understood by skilled artisans, such special definition will be expressly set forth in the specification in a definitional manner that directly and unequivocally provides the special definition for the term or phrase.

Figure 1:
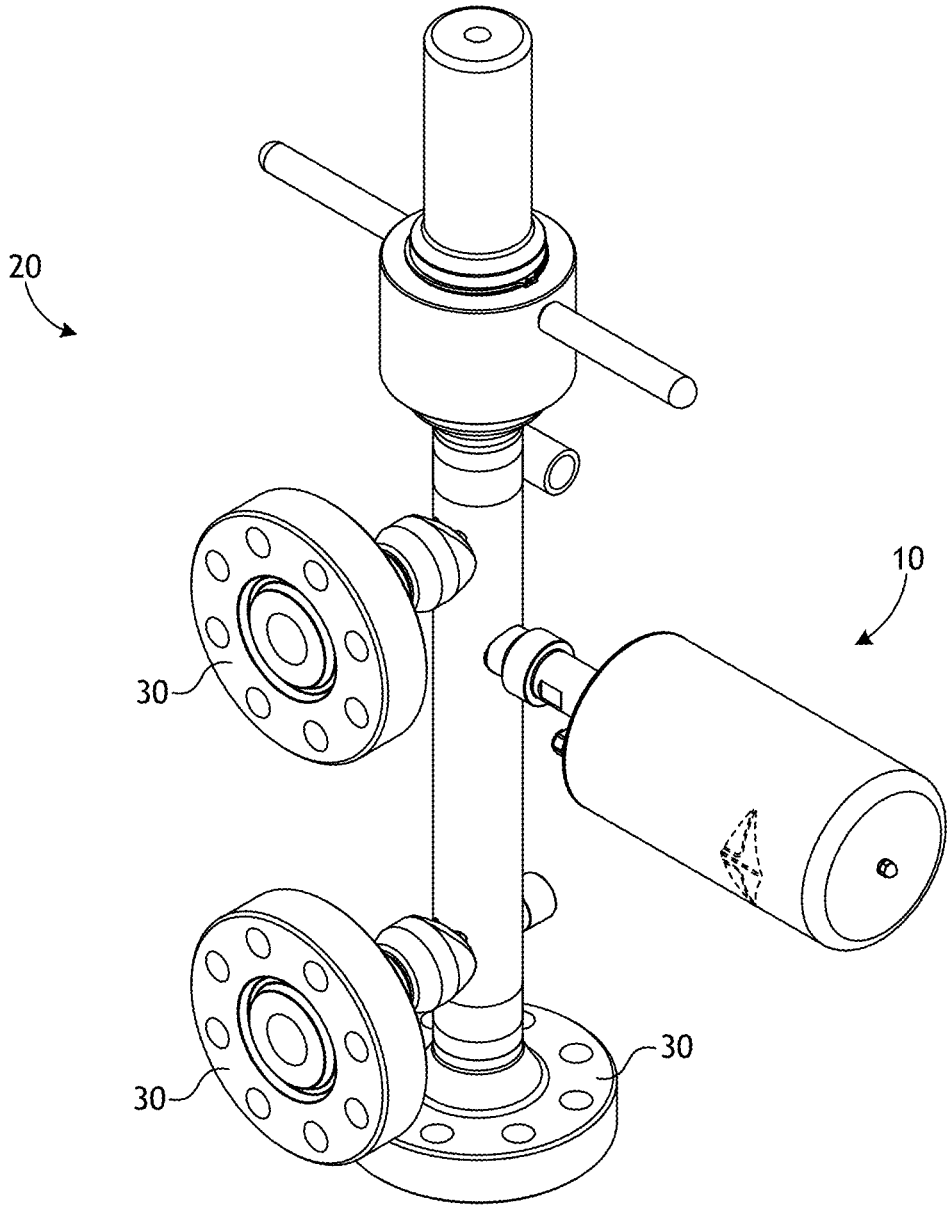
FIG. 1 is a perspective view of one embodiment of the present invention including an electronic auto-catcher attached to a lubricator.
Figure 2:
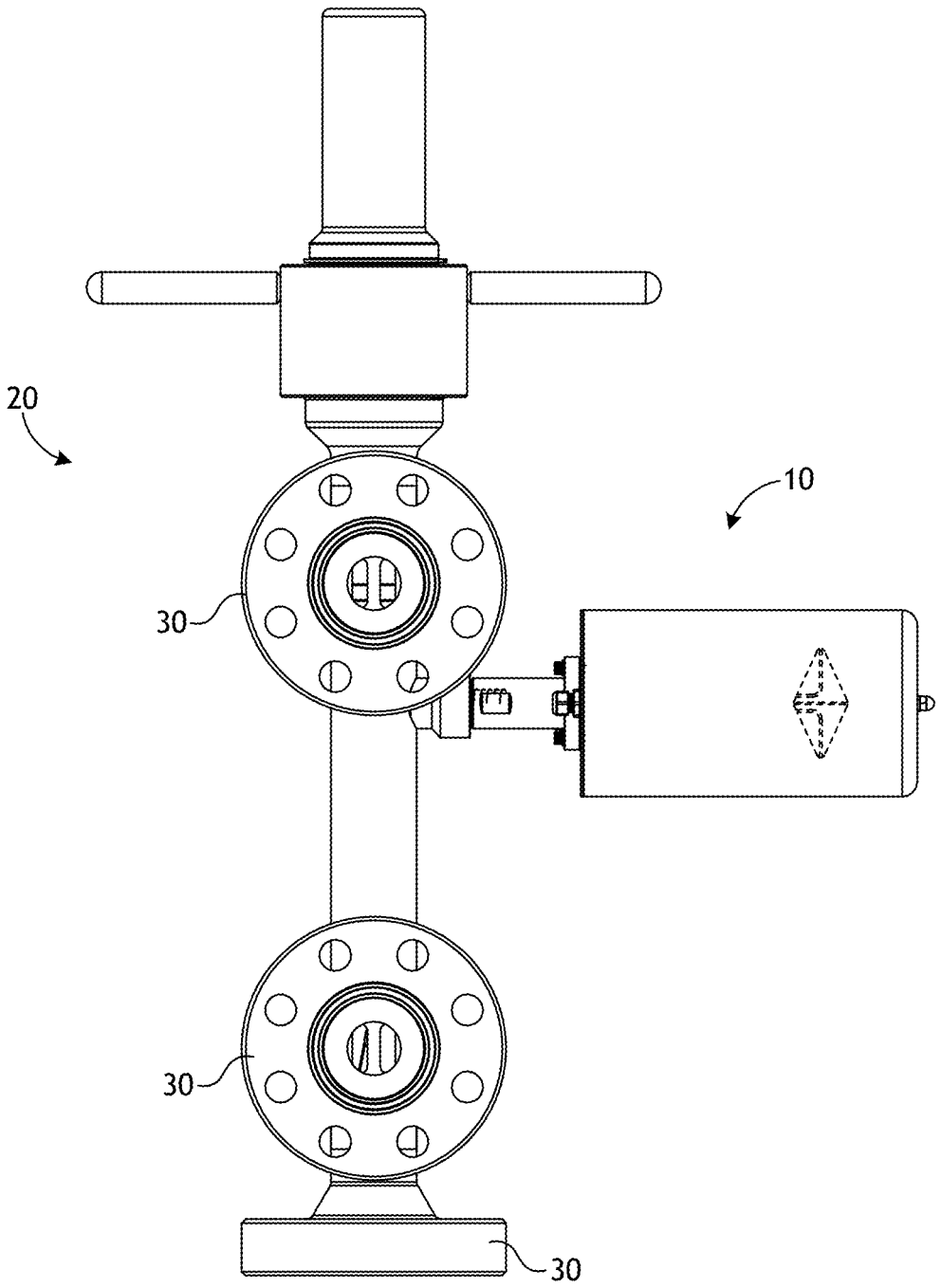
FIG. 2 is a front view of one embodiment of the present invention including an electronic auto-catcher attached to a lubricator.

The present exemplary embodiments describe an improved electronic auto-catcher, and methods of operating and using the same. For example, FIG. 1 is a perspective view of one embodiment of the present invention including electronic auto-catcher 10 attached to lubricator 20, where the lubricator includes one or more flanges 30. FIG. 2 is a front view of one embodiment of the present invention including electronic auto-catcher 10 attached to lubricator 20. As those skilled in the art will appreciate, and as shown in connection with FIG. 3, a lubricator can be designed to receive and hold a plunger, of which there are many varieties (both in terms of lubricators and plungers). For example plunger 40 shown in FIG. 3 is a dart plunger, but various other types of plungers can be used, as can various other types of lubricators.

As those skilled in the art also will appreciate, plungers of the nature shown are intended to fall (or descend) in a well in their "open" position. In the open position, gases and fluids are able to travel through the plunger until the plunger reaches the bottom of the well (or another position in the well that provides a stopping point), where the impact between the plunger and the bottom causes the plunger to close. In its "closed" position, gases and fluids are prevented from traveling through the plunger and, as a result, pressure in the well (assuming it is sufficient) causes the plunger to rise (or ascend) in the well. As the plunger ascends, liquid above it will be pushed toward the surface by virtue of the relative "tight" fit of the plunger in the well (the diameter of the plunger generally being slightly less than the diameter of the well bore) and any ribs on the outside surface of the plunger that might also help push liquid above the plunger. These liquids can then be removed at the surface of the well through one or more of its flanged connections. In this manner, a well can be "unloaded" of liquids that can otherwise reduce the efficiency and productivity of the well.

Figure 3:
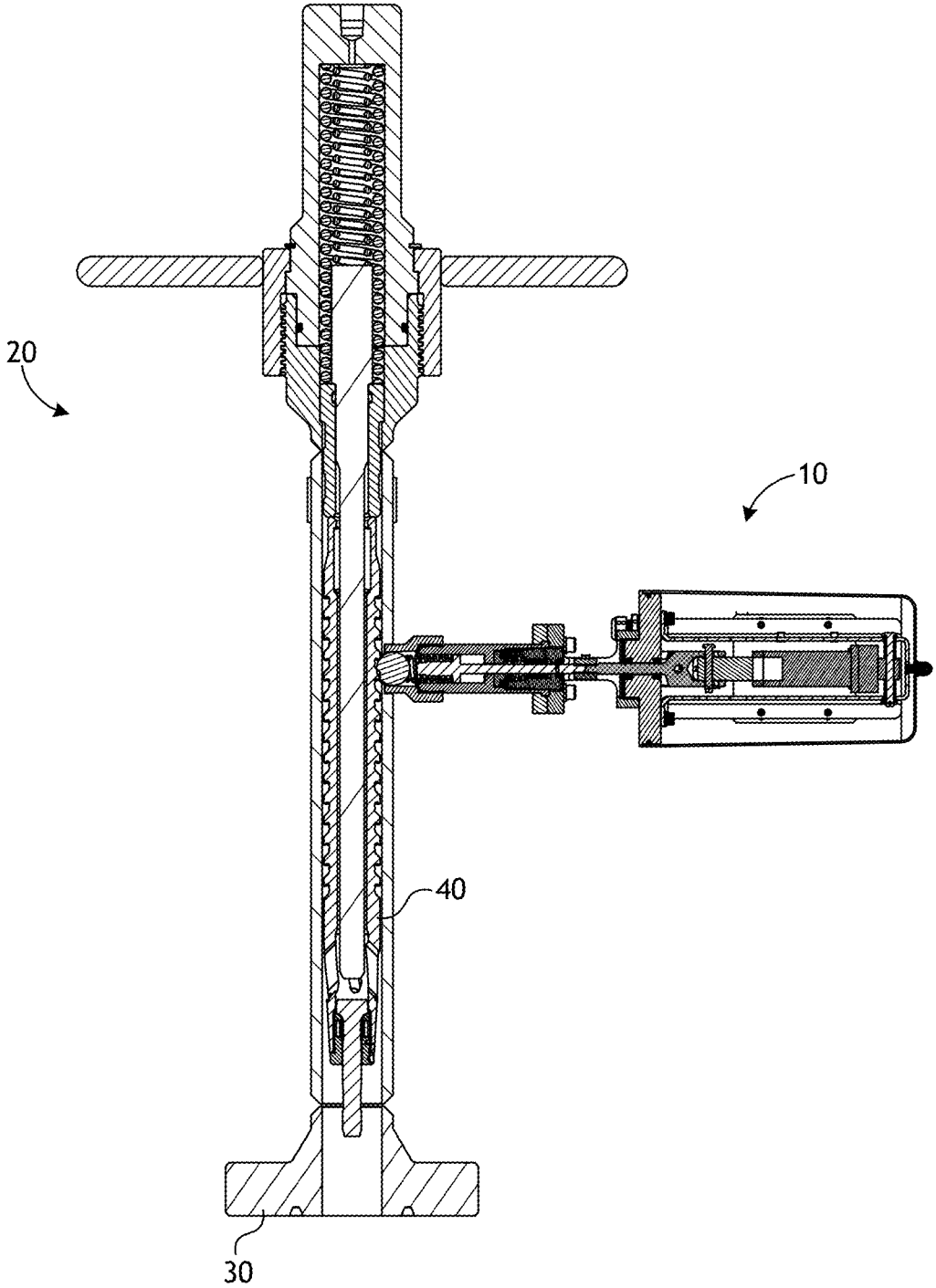
FIG. 3 is a cross-section of a lubricator (containing a plunger) with an attached electronic auto-catcher including one embodiment of the present invention.

When plunger 40 reaches the top of a well and is situated in lubricator 20 as shown in FIG. 3, it often is held there by a catcher until it is decided that the plunger should once again be deployed into the well to once again travel to the bottom and up again in order to remove liquids from the well. As indicated above, the present invention relates to a new design for the catcher, and example of which is illustrated in FIGS. 1-3 as electronic auto-catcher 10.

Figure 4:
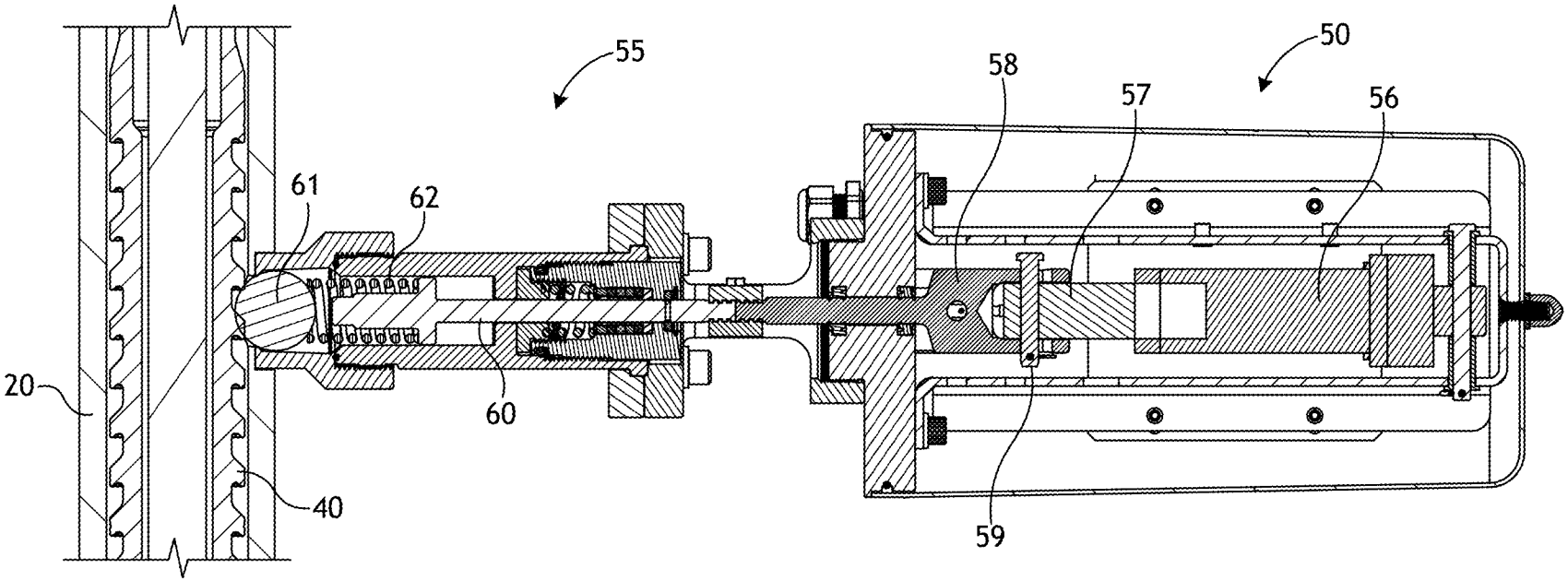
FIG. 4 is an exploded view of a portion of FIG. 3.
Figure 5:
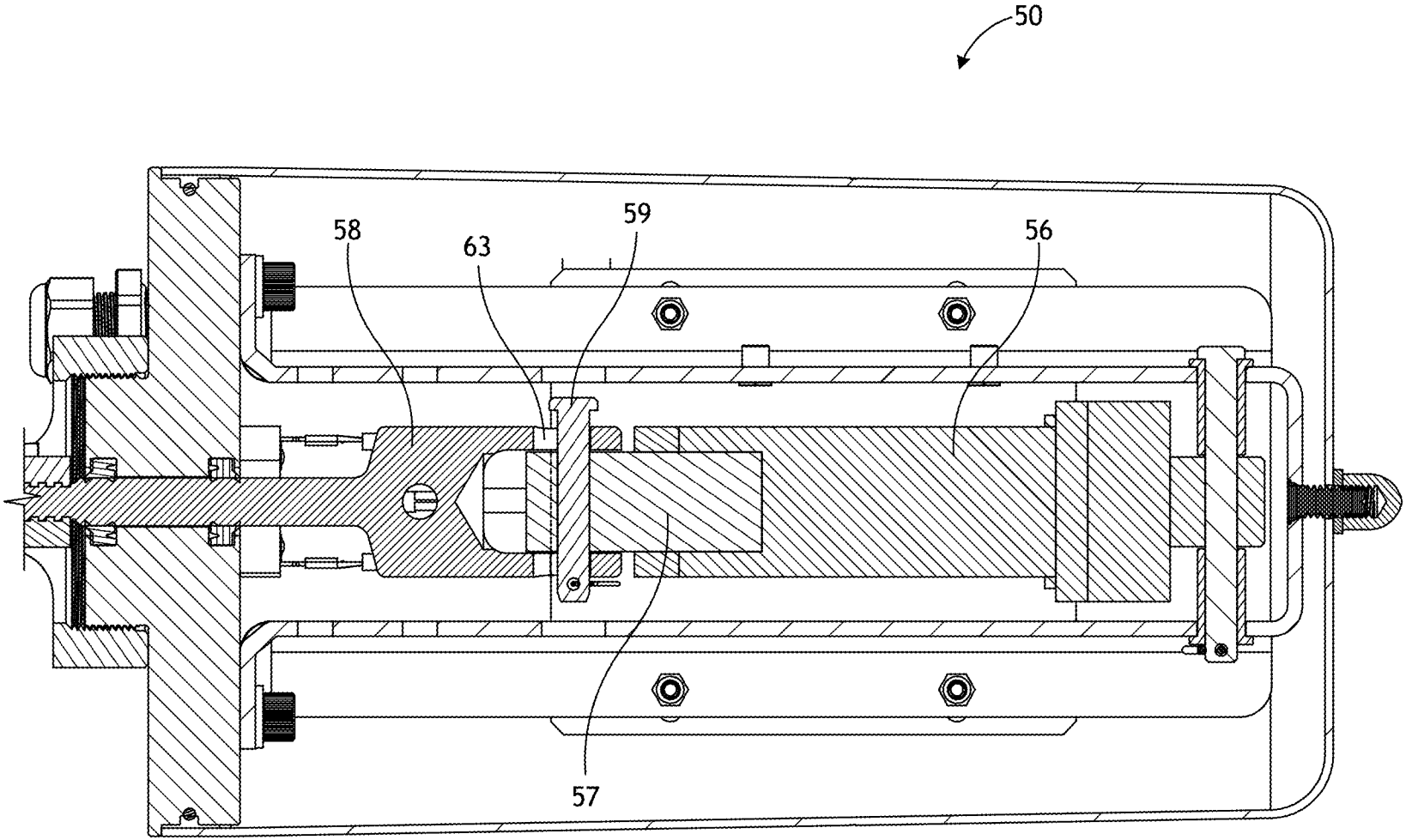
FIG. 5 is an exploded view of a portion of FIG. 3.

The details of electronic auto-catcher 10 are better seen in connection with FIGS. 4-8. As can be seen, FIG. 4 is an exploded view of a portion of FIG. 3 and better illustrates the general operation of one example of the present invention. As an initial matter, in some embodiments electronic auto-catcher 10 can be considered a combination of electronic actuator 50 (as shown and described below in more detail in connection with FIG. 5) and auto-catcher 55 (as shown and described below in more detail in connection with FIG. 6). The two can be coupled together as shown in FIG. 1-4 or they can be formed in a single unit.

Electronic actuator 50 generally operates when actuator 56 causes actuator shaft 57 to linearly move in and out (right and left in FIG. 4) of actuator 56. As those skilled in the art will appreciate, the manufacturer of electronic actuator 50 sets the linear distance actuator shaft 57 moves between its fully open and fully closed positions. Since stem adaptor 58 is coupled to actuator shaft 57 via stem pin 59, stem adaptor 58 likewise moves in and out (right and left in FIG. 4). Likewise, since catcher stem 60 is coupled to stem adaptor 58, stem 60 also moves in and out (right and left in FIG. 4). Finally, since the movement of a plunger catching device such as ball 61 is controlled at least in part by the movement of catcher stem 60, catcher ball 61 is able to move in and out (right and left in FIG. 4) of auto-catcher 55. The effect is that when ball 61 moves out of (to the left in FIG. 4) auto-catcher 55, it is able to catch/hold a plunger 40 in lubricator 20 (see FIG. 7), and when ball 61 moves into (to the right in FIG. 4) auto-catcher 55, plunger 40 is no longer held in the lubricator by the catcher (see FIG. 6).

Plunger catching devices other than ball 61 can be used in connection with the other components of electronic actuator 50 and auto-catcher 55 to retain (or not retain as the case may be) plunger 40 in lubricator 20. Moreover, other individual components identified in electronic actuator 50 and auto-catcher 55 can be combined as a single component as still be within the scope of the present invention. For example, stem adaptor 58 and catcher stem 60 could be a single component.

As those skilled in the art will appreciate, the timing of the movement of ball 61 into and out of auto-catcher 55 can be controlled in a variety of ways, including but not necessarily limited to in response to a sensor that detects the presence of the plunger in the lubricator, a calculated time, a signal from a controller, and/or manually toggling an electronic switch, where the electronic switch could have pole positions for extending the actuator, retracting the actuator, and/or an automatic mode (that causes the electronic auto-catcher to operate in response to a received signal). A mechanical override of the electronic actuator also can be incorporated so that an operator can physically open and close the auto-catcher.

As indicated above, electronic actuators like that of electronic actuator 50 tend to be "set" in the sense that their actuators 56 only move their actuator shafts 57 a set/given distance between their actuated and non-actuated conditions, i.e., between their fully open and fully closed positions. This can make it difficult to integrate them onto lubricators (or in connection with different plungers) requiring different actuation distances and/or where wear in the actuator causes the actuation distance to vary over time. For this reason, the present inventors have tailored certain aspects of embodiments of their invention to accommodate this feature of said actuators.

In one aspect and exemplary embodiment, stem adaptor 58 has been adapted to include gap 63 (see FIG. 5 and FIGS. 8A-8C) such that gap 63 is larger/longer than the outside diameter of stem pin 59. As indicated above and as shown at least in FIG. 5, stem pin 59 connects stem adaptor 58 to actuator shaft 57. But since gap 63 is larger than the outside diameter of stem pin 59, actuator shaft 57 is able to move a distance equal to the difference between the length/size of gap 63 and the outside diameter of stem pin 59 before actuator shaft 57 causes stem adaptor 58 to move. This design thus reduces the lateral movement of stem adaptor 58, catcher stem 60, and ball 61, where the amount of such reduction can be dictated by the size of gap 63, the outside diameter of stem pin 59, and/or a combination of the two. Other methods of similarly attenuating or dampening the movement of stem adaptor 58, catcher stem 60, and/or ball 61 relative to the movement of actuator shaft 57 are possible and within the scope of the present invention. Accordingly, this design can be useful where using the electronic auto-catcher to catch a plunger in a lubricator does not require (or is incompatible with) an electronic actuator having a set/given distance between its actuated and non-actuated conditions that is too long.

Figure 8A:
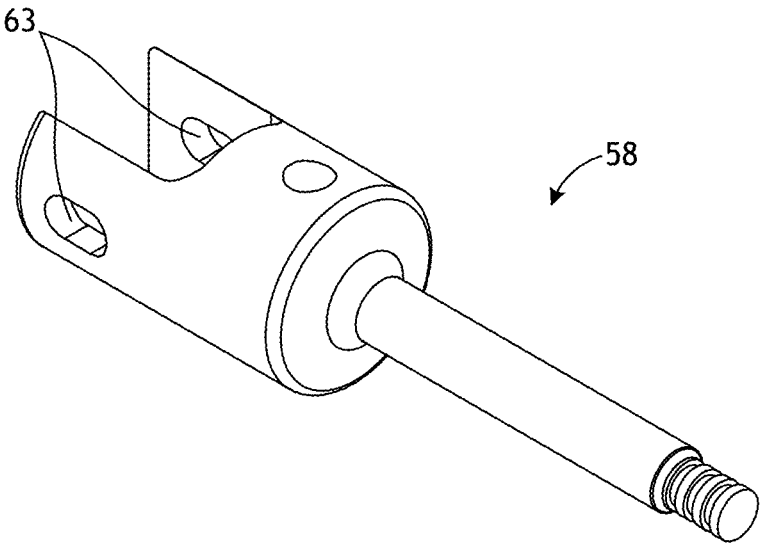
FIG. 8A is perspective view of the stem adaptor shown in FIGS. 3-5.
Figure 8B:
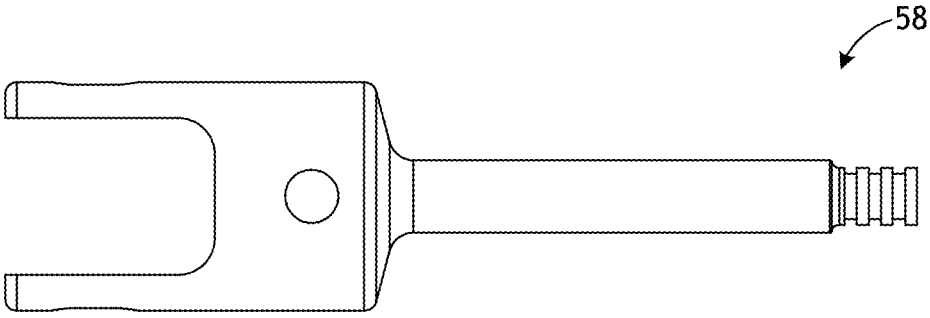
FIG. 8B is a top view of the stem adaptor shown in FIGS. 3-5.
Figure 8C:
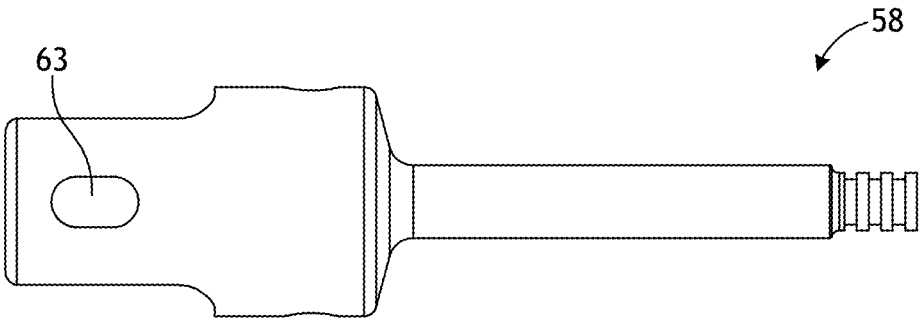
FIG. 8C is a side view of the stem adaptor shown in FIGS. 3-5.

FIGS. 8A, 8B, and 8C better illustrate an exemplary embodiment of stem adaptor 58. Specifically, FIG. 8A is perspective view of the exemplary stem adaptor. FIG. 8B is a top view of the exemplary stem adaptor. FIG. 8C is a side view of the exemplary stem adaptor.

Figure 6:
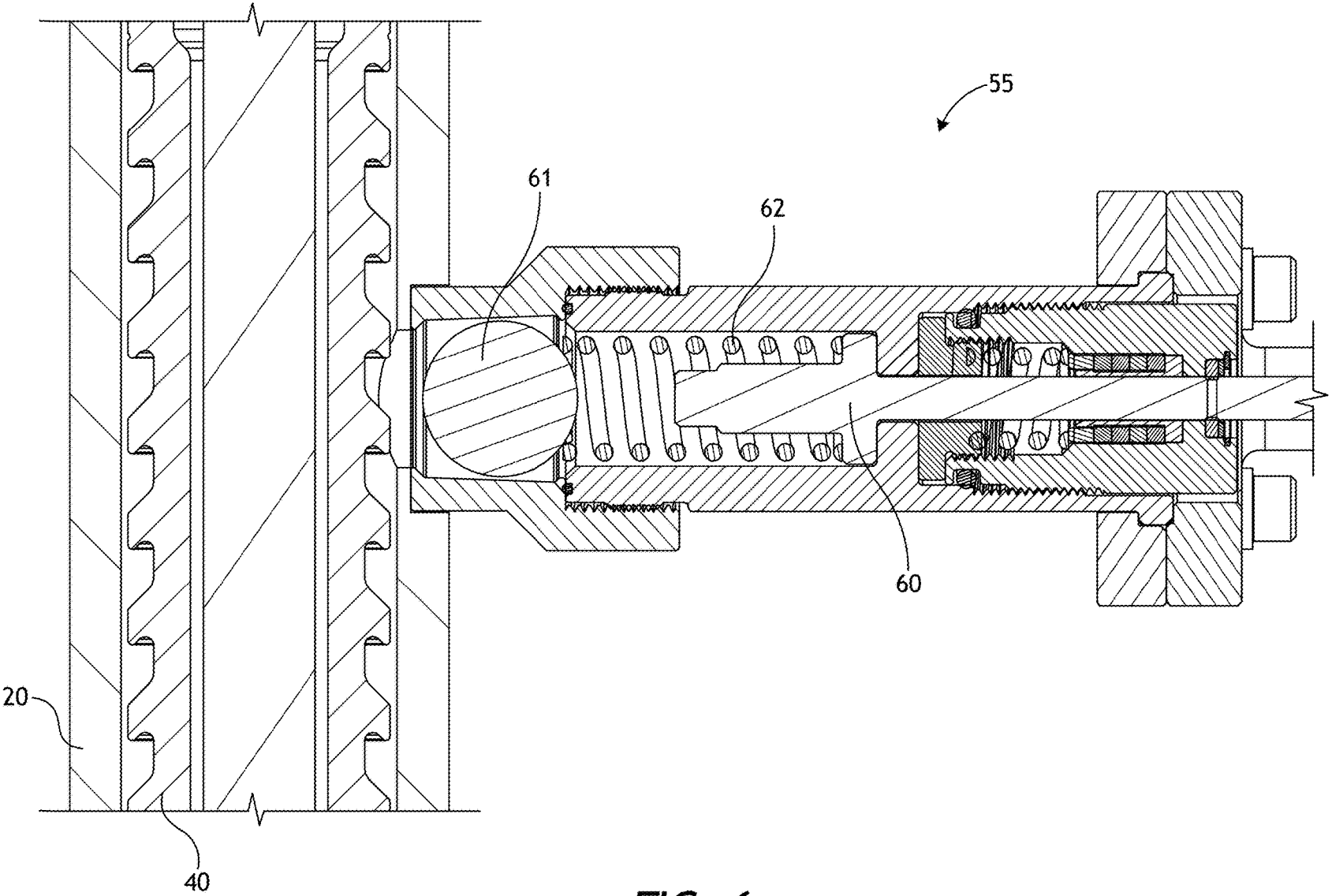
FIG. 6 is an exploded view of a portion of FIG. 3, but with the actuator retracted.
Figure 7:
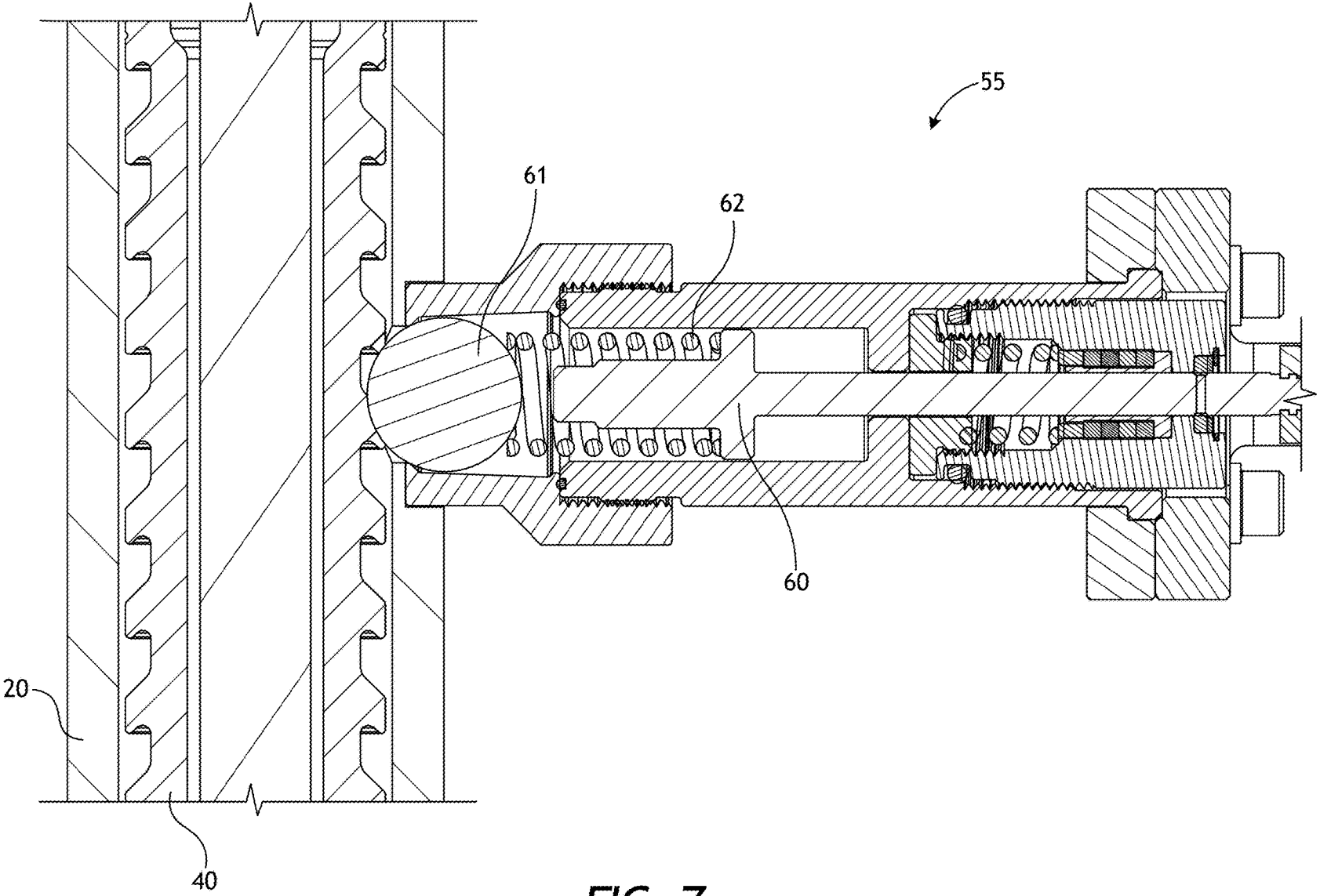
FIG. 7 is an exploded view of a portion of FIG. 3.

As an alternative to and/or in combination with stem adaptor 58 being provided with gap 63, catcher spring 62 can be placed between ball 61 and catcher stem 60, as shown in FIGS. 4, 6, and 7, to likewise reduce the lateral movement of ball 61 relative to the set/fixed lateral movement of actuator shaft 57. Specifically, as shown in connection with FIGS. 4, 6, and 7, catcher spring 62 effectively dampens the movement of ball 61 relative to the set/fixed lateral movement of actuator shaft 57 by absorbing (more or less depending on the rating of spring 62) the force exerted on ball 61 by catcher stem 60. The amount of dampening can be adjusted at least by selecting spring 62 of a different rating.

Accordingly, in operation when plunger 40 arrives in lubricator 20 the plunger can be held there by actuating (either automatically or manually as described above) the electronic auto-catcher, i.e., electronic actuator 50 actuates actuator 56, which causes actuator shaft 57 to extend out from actuator 56, which ultimately (due to gap 63) causes stem adaptor 58 to move toward ball 61, which causes catcher stem 60 to move toward ball 61, which ultimately (due to spring 62) causes ball 61 to move into lubricator 20 to hold plunger 40 in place in the lubricator. FIG. 7 illustrates an embodiment in which electronic auto-catcher 10 is holding plunger 40 in lubricator 20. Releasing plunger 40 from lubricator 20 so that the plunger falls into the well can be done by actuating (either automatically or manually as described above) the electronic auto-catcher, i.e., electronic actuator 50 actuates actuator 56, which causes actuator shaft 57 to withdraw into actuator 56, which ultimately (due to gap 63) causes stem adaptor 58 to move away from ball 61, which causes catcher stem 60 to move away from ball 61, which ultimately (due to spring 62) causes ball 61 to move out of lubricator 20 so as to no longer hold plunger 40 in place in the lubricator. FIG. 6 illustrates an embodiment in which electronic auto-catcher 10 is no longer holding plunger 40 in lubricator 20.

Although the invention(s) is/are described herein with reference to specific embodiments, various modifications and changes can be made without departing from the scope of the present invention(s), as set forth in the claims below. Accordingly, the specification and Figures are to be regarded in an illustrative rather than a restrictive sense, and all such modifications are intended to be included within the scope of the present invention(s). Any benefits, advantages, or solutions to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements. The terms "coupled" or "operably coupled" are defined as connected, although not necessarily directly, and not necessarily mechanically. The terms "a" and "an" are defined as one or more unless stated otherwise. The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system, device, or apparatus that "comprises," "has," "includes" or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

Accordingly, the protection sought herein is as set forth in the claims below.

The invention claimed is:

1. An electronic auto-catcher for coupling to a wellhead lubricator to catch and release a plunger, comprising:

an electronic actuator including an actuator shaft that laterally moves into and out of an actuator in the electronic actuator;

a stem adaptor attached to the actuator shaft to move in the same lateral direction as the actuator shaft; and a catcher stem, wherein the stem adaptor is coupled to the catcher stem so that lateral movement of the stem adaptor causes lateral movement of the catcher stem, and wherein the stem adaptor is attached to the actuator shaft such that lateral movement of the actuator shaft by a first distance causes lateral movement of the stem adaptor by a second distance, where the second distance is less than the first distance.

2. The electronic auto-catcher of claim 1 wherein the catcher stem is configured to at least assist in catching and releasing the plunger in the wellhead lubricator.

3. The electronic auto-catcher of claim 2 wherein the catcher stem is coupled to a plunger catching device that catches and releases the plunger in the wellhead lubricator.

4. The electronic auto-catcher of claim 3 wherein the catcher stem is coupled to the plunger catching device such that lateral movement of the catcher stem causes lateral movement of the plunger catching device.

5. The electronic auto-catcher of claim 4 wherein the catcher stem interfaces with the plunger catching device such that lateral movement of the catcher stem by a third distance causes lateral movement of the plunger catching device by a fourth distance, where the fourth distance is less than the third distance.

6. The electronic auto-catcher of claim 5 wherein the stem adaptor is attached to the actuator shaft by a stem pin.

7. The electronic auto-catcher of claim 6 wherein the stem adaptor includes a stem pin gap.

8. The electronic auto-catcher of claim 7 wherein the stem pin has a width and the stem pin gap has a width larger than width of the stem pin.

9. The electronic auto-catcher of claim 8 wherein the difference between the width of the stem pin gap and the width of the stem pin is substantially equal to the difference between the first distance and the second distance.

10. The electronic auto-catcher of claim 9 wherein the catcher stem includes a spring positioned at least between a portion of the catcher stem and the plunger catching device, wherein the spring deforms an amount substantially equal to the difference between the third distance and the fourth distance.

11. The electronic auto-catcher of claim 10 wherein the plunger catching device is a ball.

12. The electronic auto-catcher of claim 1 wherein the stem adaptor and the catcher stem are separate components.

13. The electronic auto-catcher of claim 1 wherein the catcher stem is coupled to the stem adaptor so the catcher stem moves in the same lateral direction as the stem adaptor.

14. An electronic auto-catcher for catching and releasing a plunger, comprising:

an actuator shaft that laterally moves into and out of an actuator by electronic means, whereby said lateral movement out of the actuator enables the electronic auto-catcher to catch the plunger, and said lateral movement into the actuator enables the electronic auto-catcher to release the plunger, wherein the actuator shaft is coupled to a stem adaptor such that lateral movement of the actuator shaft by a first distance causes lateral movement of the stem adaptor by a second distance, where the second distance is less than the first distance.

15. The electronic auto-catcher of claim 14 including a catcher stem attached to the stem adaptor so that lateral movement of the stem adaptor causes lateral movement of the catcher stem.

16. The electronic auto-catcher of claim 15 wherein the catcher stem is configured to at least assist in catching and releasing the plunger.

17. The electronic auto-catcher of claim 16 wherein the catcher stem is coupled to a plunger catching device that catches and releases the plunger.

18. The electronic auto-catcher of claim 17 wherein the catcher stem is coupled to the plunger catching device such that lateral movement of the catcher stem causes lateral movement of the plunger catching device.

19. The electronic auto-catcher of claim 18 wherein the catcher stem interfaces with the plunger catching device such that lateral movement of the catcher stem by a third distance causes lateral movement of the plunger catching device by a fourth distance, where the fourth distance is less than the third distance.

20. The electronic auto-catcher of claim 19 wherein the stem adaptor is attached to the actuator shaft by a stem pin.

21. The electronic auto-catcher of claim 20 wherein the stem adaptor includes a stem pin gap.

22. The electronic auto-catcher of claim 21 wherein the stem pin has a width and the stem pin gap has a width larger than width of the stem pin.

23. The electronic auto-catcher of claim 22 wherein the difference between the width of the stem pin gap and the width of the stem pin is substantially equal to the difference between the first distance and the second distance.

24. The electronic auto-catcher of claim 23 wherein the catcher stem includes a spring positioned at least between a portion of the catcher stem and the plunger catching device, wherein the spring deforms an amount substantially equal to the difference between the third distance and the fourth distance.

25. The electronic auto-catcher of claim 24 wherein the plunger catching device is a ball.

26. The electronic auto-catcher of claim 15 wherein the stem adaptor and the catcher stem are separate components.

* * * * *